US006520731B2

(12) United States Patent
MacLeod

(10) Patent No.: US 6,520,731 B2
(45) Date of Patent: Feb. 18, 2003

(54) CLOSED CIRCUIT SWING CONTROL SYSTEM

(75) Inventor: Ian J. C. MacLeod, Ames, IA (US)

(73) Assignee: Sauer-Danfoss, Inc., Ames, IA (US)

( * ) Notice: Subject to any disclaimer, the term of this patent is extended or adjusted under 35 U.S.C. 154(b) by 0 days.

(21) Appl. No.: 09/893,257

(22) Filed: Jun. 27, 2001

(65) Prior Publication Data

US 2003/0002972 A1 Jan. 2, 2003

(51) Int. Cl.[7] ..... E02F 3/00

(52) U.S. Cl. ..... 414/695.5; 414/694; 60/473; 60/476

(58) Field of Search ..... 414/695.5, 694; 60/473, 476

(56) References Cited

U.S. PATENT DOCUMENTS 3,747,350 A 7/1973 West et al.
3,775,980 A 12/1973 Spirdco
3,999,387 A 12/1976 Knopf
4,757,685 A * 7/1988 Burckhartzmeyer ..... 60/452
5,108,267 A * 4/1992 Horst ..... 417/218
5,413,452 A 5/1995 Lech et al.
5,845,559 A * 12/1998 Schroeder et al. ..... 92/12.2
6,065,288 A * 5/2000 Glomeau ..... 60/476
6,375,433 B1 * 4/2002 Du et al. ..... 417/53

FOREIGN PATENT DOCUMENTS

JP 401299301 A * 12/1989 ..... F15B/9/04

* cited by examiner

*Primary Examiner*—Eileen D. Lillis
*Assistant Examiner*—Michael S Lowe

(57) ABSTRACT

A control system for swing cylinders to position a boom on a backhoe or the like includes a pair of double acting hydraulic cylinders on the backhoe frame operatively connected to the boom for swinging the boom with respect to the frame, a closed circuit pump arranged in a closed circuit with the hydraulic cylinders such that the control on the pump is the sole means of controlling the cylinders.

7 Claims, 3 Drawing Sheets

CLOSED CIRCUIT SWING CONTROL SYSTEM

BACKGROUND OF THE INVENTION

The present invention relates to the field of hydraulic control systems for the swing drives of cranes, backhoes, power shovels, and related apparatus.

For example, on a loader backhoe, there are a number of factors that reduce the performance of the swing system, including but not limited to air in the oil, inconsistent loads on the bucket, viscosity of the oil (temperature), and valve performance. These factors lead to control and performance issues such as backhoe oscillation, inconsistent stop control, and drift. Typically, swing control is accomplished by using an open circuit pump and a dedicated valve or sets of valves that are interposed between the pump and the hydraulic motors or hydraulic cylinders of the swing mechanism. Heretofore, such systems have proven to be complex in design and therefore expensive to manufacture. Thus, there is a need for swing control system that overcomes these deficiencies.

Thus, a primary objective of the present invention is the provision of an improved swing control system.

A further objective of this invention is the provision of a swing control system that utilizes a closed circuit pump to directly control hydraulic cylinders for swing control, thereby eliminating the need for complex and costly intervening swing control valving.

A further objective of the present invention is to provide a simple, inexpensive, and improved swing control system for a loader backhoe or the like.

A further objective of the present invention is a provision of a swing control system that is accurate, relatively insensitive to leakage, and reliable in use.

These and other objectives will be apparent from the drawings as well as from the description and claims that follow.

BRIEF SUMMARY OF THE INVENTION

The present invention relates to a control system for the swinging of booms on backhoes, cranes, or similar material handling apparatus. This invention provides more direct control of the hydraulic swing cylinders and eliminates the need for additional complex valving and circuitry.

The control system of this invention is adapted for a material handling apparatus that includes a frame and a boom movably (usually pivotally or swingably) attached to the frame. A pair of double acting hydraulic cylinders on the frame connect in an opposing or inversely operating manner to the boom for swinging the boom with respect to the frame. The cylinders are hydraulically connected such that when fluid is supplied to one of the cylinders to extend its piston rod, that same fluid retracts the piston rod in the other cylinder, or vice-versa, to swing the boom with respect to the frame. The cylinders are directly controlled by a variable displacement hydraulic pump arranged in a closed circuit with the cylinders. The pump has a servo control associated therewith that is connected to a displacement varying means (such as a swashplate) disposed at least partially inside the pump, which establishes both the volume and direction of the flow of hydraulic fluid in the closed circuit. No separate swing control valve is required. The servo control on the pump is the sole means of controlling the cylinders.

DETAILED DESCRIPTION OF THE PREFERRED EMBODIMENT

Figure 1:
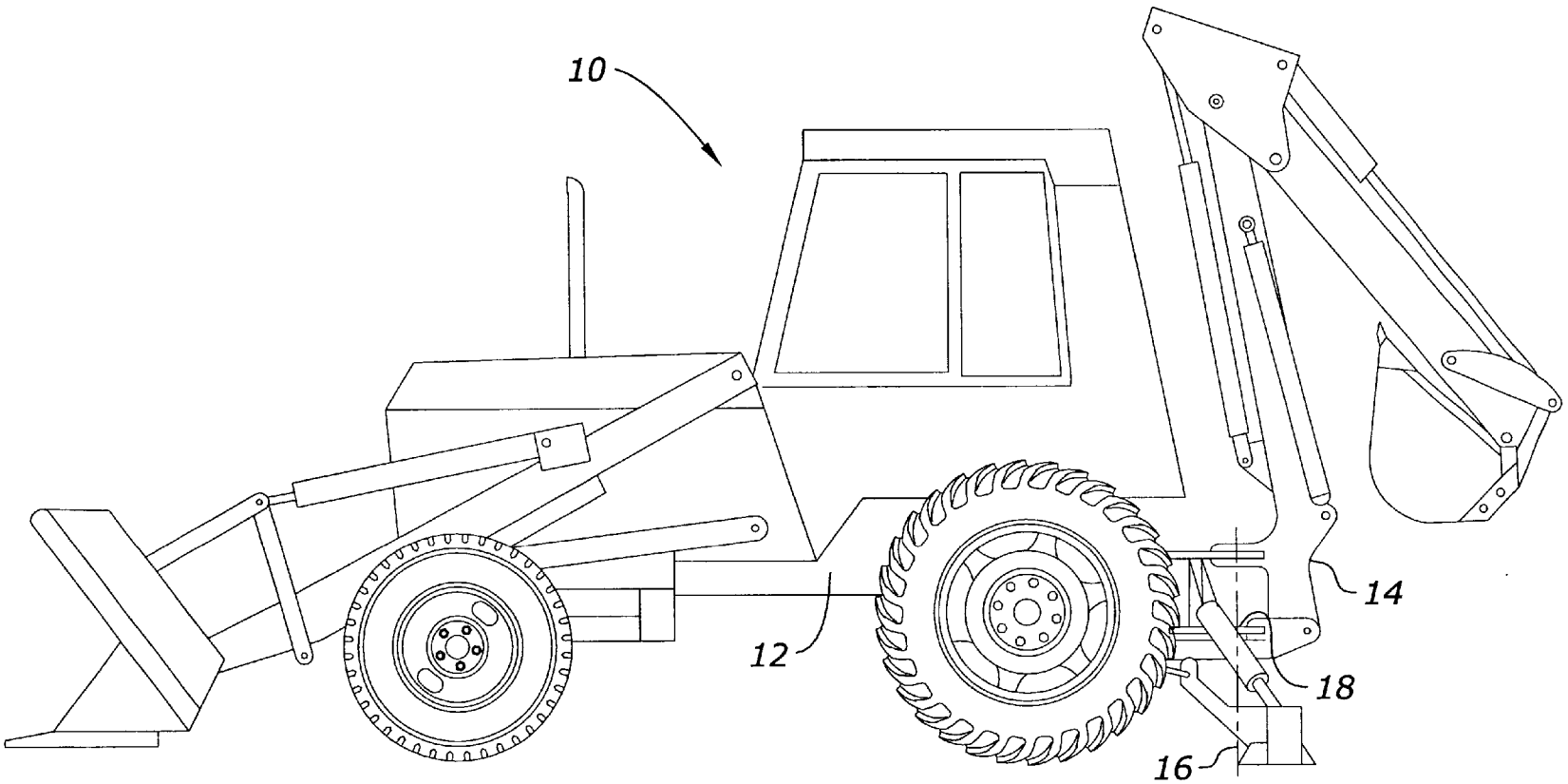
FIG. 1 is a side elevation view of a backhoe which can be equipped with the present invention.

In the figures and the description that follows, like components are designated with like reference numerals. Referring to FIG. 1, a backhoe 10 constitutes a material handling apparatus including a frame 12 and an elongated boom 14 movably attached to the frame. Preferably the boom 14 pivotally or swingably attaches to the frame 12 along a pivot axis or swing axis 16 and secures for rotation with a swing bracket 18, which in turn pivotally attaches to the frame 12 (FIGS. 2 and 3).

Figure 2:
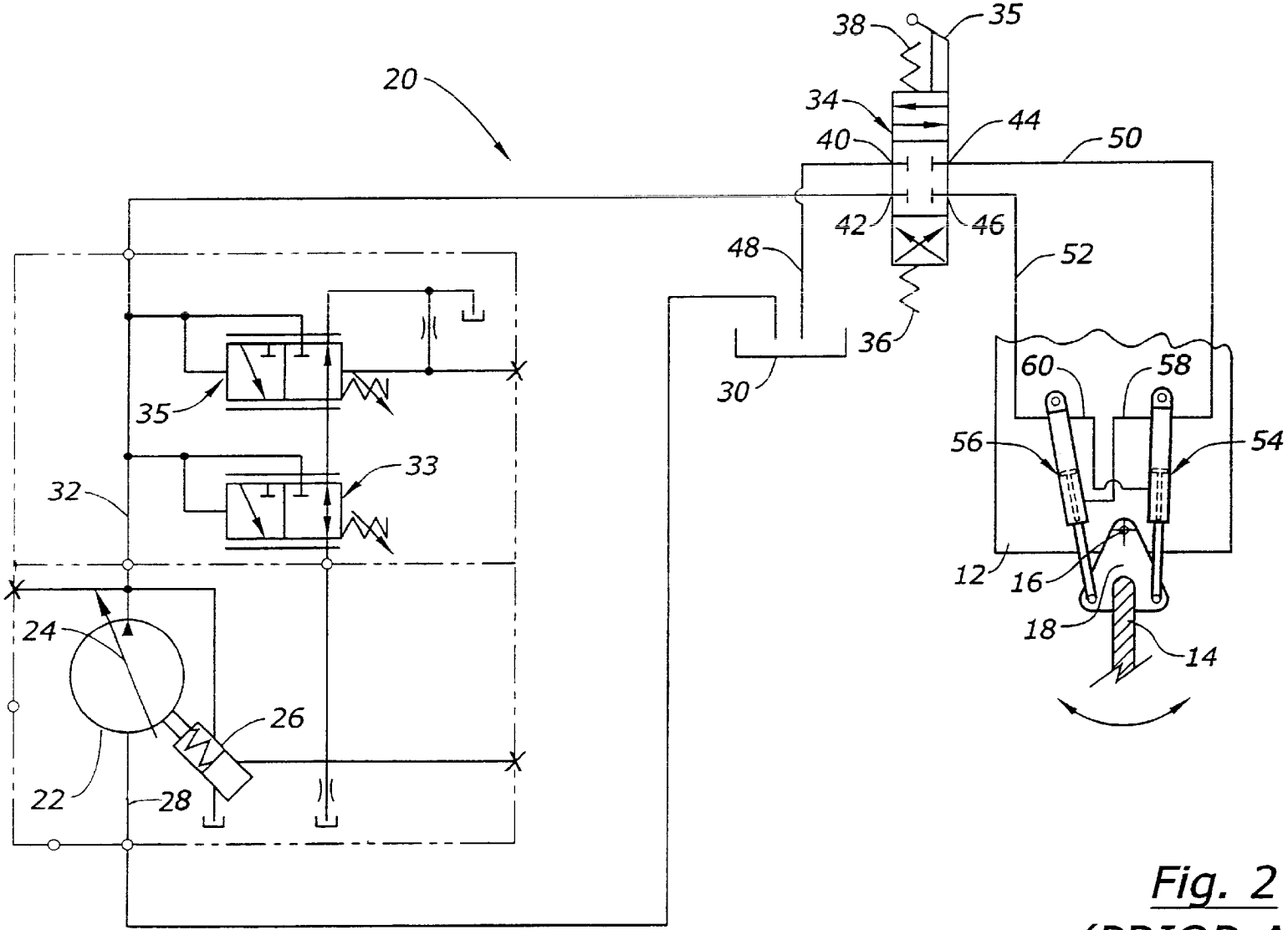
Fig. 2 (PRIOR ART)
FIG. 2 is a diagram depicting the major hydraulic and mechanical components of a prior art open circuit swing control system for the backhoe of FIG. 1.
Figure 3:
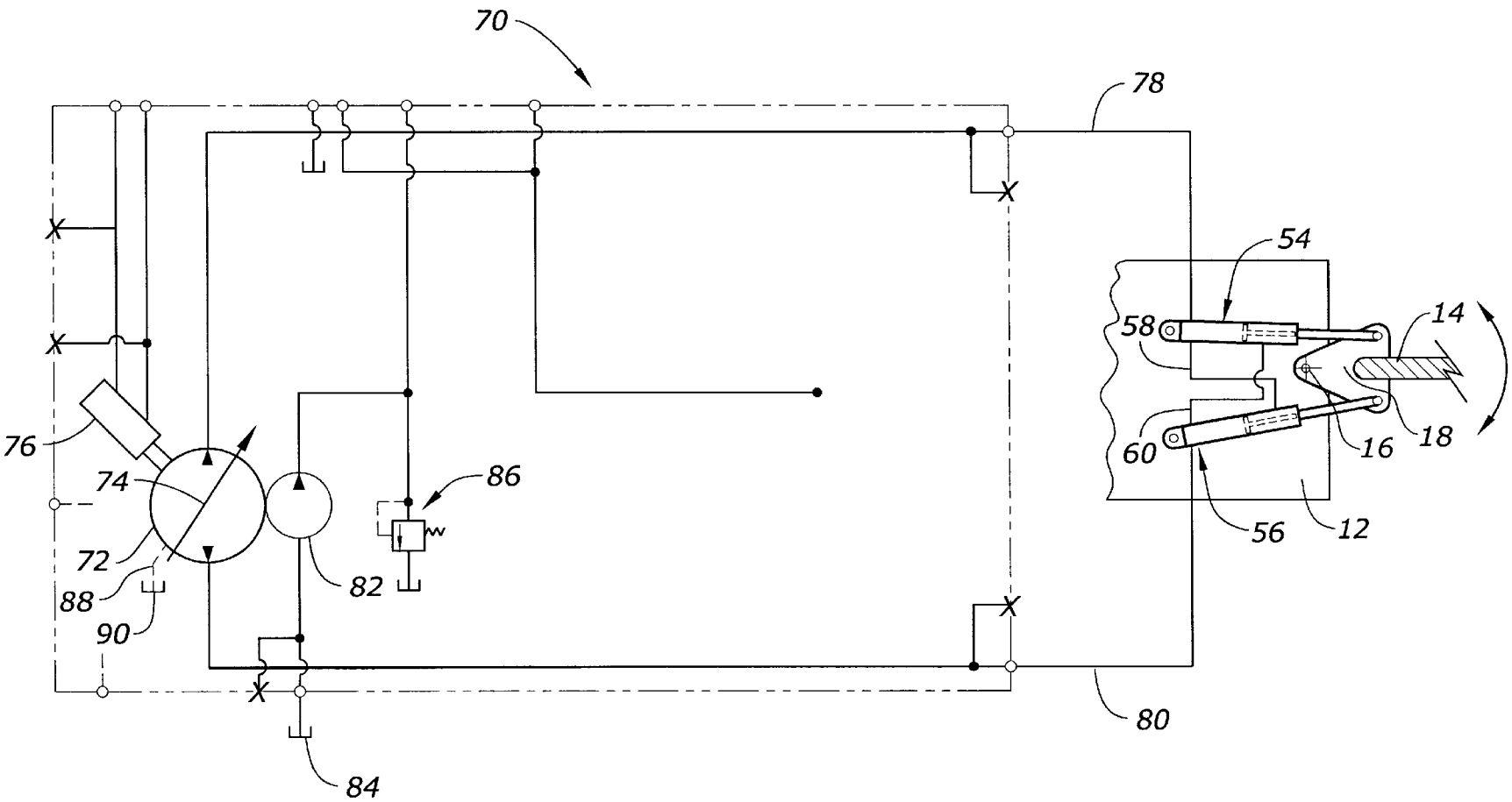
FIG. 3 is a diagram similar to FIG. 2 but depicts the closed circuit swing control system of the present invention.

In order to understand the closed circuit swing control system of the present invention, it is first necessary to understand the conventional open circuit swing control system 10 of FIG. 2. The conventional open circuit swing control system 20, includes a uni-directional, variable displacement open circuit pump 22 with a movable swashplate 24. The swashplate 24 is connected to and controlled by a servo 26 in a conventional manner to affect the fluid displacement of the pump 22. The pump 22 has a suction inlet 28 fluidly connected to a reservoir 30. The reservoir 30 has a relatively large capacity or volume for storing hydraulic fluid. This large volume is necessary because the circuit is open. The pump 22 must provide the whole circuit with pressurized fluid and the reservoir must be large enough to store that volume of fluid. The pump 22 has an outlet or supply line 32 that is fluidly connected to a directional control valve 34, which is also commonly referred to in the art as a swing control valve. An actuating means 35, such as a handle, solenoid, etc., is provided on the swing control 34. Adjustable pressure compensating and pressure limiting valves 33, 35, fluidly connect to the pump outlet or supply line 32 as shown.

The swing control valve 34 is a 3-position 4-way (port) valve, which is centered by springs 36, 38 to a central position wherein all of the ports 40, 42, 44, 46 are blocked. A drain line 48 fluidly connects port 40 to the reservoir 30. Lines 50 and 52 fluidly connect a pair of hydraulic swing cylinders 54 and 56 respectively to the swing control valve 34. Fluid enters the control valve 34 from the pump outlet 32 through a supply port 42.

The swing cylinders 54, 56 are double acting hydraulic cylinders whose construction is well known in the art and therefore will not be described in detail herein. However, suffice it to say that the swing cylinders 54, 56 each include a piston and rod assembly slidably yet sealingly mounted in a cylindrical housing. The piston rod exits from the housing in a sealed fashion and the piston substantially seals against the interior wall of the housing to form two opposing pressurizable chambers, one hereinafter referred to as an upper chamber above the piston and another referred to hereinafter as a lower chamber around the rod. A hydraulic line 50 fluidly connects the port 44 of the swing control 34 to the upper chamber in cylinder 54. A hydraulic line 60 connects the lower chamber in cylinder 54 with the upper chamber in cylinder 56, and thereby with line 52 and port 46. A second hydraulic line 58 fluidly connects the lower chamber in cylinder 56 with the upper chamber in cylinder 54, and thereby with line 50 and port 44. The piston rods of the cylinders 54, 56 are pivotally connected to the swing bracket 18 at points offset from the swing axis 16. The other ends of the cylinders 54, 56 are pivotally connected to the frame 12.

The conventional swing control system 20 of FIG. 2 operates as follows. The pump 22 draws fluid from the reservoir 30, pressurizes it, and delivers it to the supply port 42 of the swing control valve 34 through the supply line 32. If the valve 34 is in the central position, no fluid is permitted to flow to or from the swing cylinders 54, 56, and the boom 14 generally maintains its present position. Internal leakage in the control valve 34 can cause the boom to drift from its intended position.

When the operator causes the actuating means 35 to move the valve 34 to the top position in FIG. 2, pressurized fluid can flow between the ports 42 and 46 of the swing control valve 34. Then the fluid flows through the upper chamber of cylinder 56 through line 52 and into the lower chamber of cylinder 54 through line 60. The fluid simultaneously forces the piston and rod assemblies of cylinders 54 and 56 to move inversely or in opposite directions. As a result, fluid is forced from the lower chamber of cylinder 56 into the upper chamber of cylinder 54, where it is likewise forced toward the port 44 of the valve 34 through line 50. The swing control valve 34 permits this fluid to return to the reservoir 30 through the ports 44, 40 and the drain line 48. The overall result of the swing control valve 34 being placed in the upper position is that the cylinder 56 extends and the cylinder 54 retracts, which swings the bracket 18 and the boom 14 attached thereto in a counter clockwise direction about the pivot axis 16. When the control 34 is placed in the lower position, the fluid flows are reversed, as is the extension and retraction of the cylinders 54, 56. Thus, the bracket 18 and the boom 14 swing in a clockwise direction as seen in FIG. 2.

By contrast, the closed circuit swing control system 70 of the present invention is shown in FIG. 3. The control system 70 includes a variable displacement closed circuit pump 72 that is associated with the frame 12 of the backhoe 10 (FIG. 1). More preferably, the pump 72 is mounted on the frame 12 and driven by the backhoe's engine (not shown). The fluid displacement or output of the pump 72 is determined by the angular position of a swashplate 74. The swashplate 74 is arranged so as to be permitted to go over center such that the pump 72 can displace more fluid in opposite directions within the closed circuit loop. A control servo 76 operatively connects with or preferably couples with the swashplate 74 for controlling the angular position thereof. Thus, the control servo 76 controls the fluid displacement and output direction of the pump 72 through closed circuit loop that includes system pressure lines 78 and 80.

A fixed displacement charge pump 82 is associated with the pump 72 and is connected with conventional circuitry (not shown) to make up any fluid losses that occur in the closed circuit hydraulic loop by drawing fluid from a relatively small reservoir 84. The reservoir 84 in the closed circuit swing control system 70 (FIG. 3) is considerably smaller than the reservoir 30 (FIG. 2) required in the open circuit swing control system. The reservoir 84 merely has to be large enough to hold make-up fluid for the closed circuit loop, and does not have to hold all of the fluid that usually resides in the closed circuit loop. A charge relief valve 86 is included downstream of the charge pump 82. The pump 72 has a case drain line 88 which routes the internal fluid leakage experience by the pump 72 to a case drain 90, as is conventional.

The system pressure lines 78, 80 fluidly connect the pump 72 directly to the hydraulic swing cylinders 54, 56 as shown in FIG. 3. Thus the pump 72, system pressure lines 78, 80, and the swing cylinders 54, 56 are arranged in a closed circuit hydraulic loop. System pressure line 78 directly connects the pump 72 to the swing cylinder 54. System pressure line 80 directly connects the pump 72 to the swing cylinder 56. Again, lines 58 and 60 interconnect the cylinders so that their piston rods move inversely with respect to each other. The need for any intervening swing control valves like valve 34 of FIG. 2 is avoided. The control servo 76 is effectively the sole valve or means for controlling the cylinders 54, 56.

In operation, the closed circuit swing control system 70 of the present invention operates as follows. If the operator wants to swing the boom 14 in a clockwise direction, the operator actuates the control servo 76 so as to move the swashplate 74 to an angular position that causes the pump 72 to displace a proportional volume of hydraulic fluid through the system pressure line 78 to the swing cylinder 54. The piston rod of the swing cylinder 54 extends proportionally and the swing cylinder 56 retracts inversely such that the swing bracket 18 and the boom 14 attached thereto swing in a clockwise direction. As another result of the movement of the piston rods of the cylinders 54, 56, hydraulic fluid is forced from cylinder 56 through the system pressure line 80 and returned to the pump 72.

If the operator wants the boom 14 to swing in the opposite direction, the operator actuates the control servo 76 to move the swashplate 74 to an angular position on the other side of its neutral or no-flow position. The pump 72 then displaces fluid in a counter-clockwise direction within the closed circuit loop. The pump 72 supplies pressurized fluid through system pressure line 80 to the swing cylinder 56, causing its piston rod to extend and the piston rod of the cylinder 54 to retract. The swing bracket 18 and the boom 14 are thereby swung in a counter-clockwise direction. Hydraulic fluid forced out of the swing cylinders 56, 54 returns to the pump 72 through the system pressure line 78.

Preferably, the swing cylinders 54, 56 are identical or at least equal in their functional operating parameters (effective volumes, piston areas, etc.). Therefore, the system 70 does not require any special valves to adjust for any differential cylinder volume. The bi-directional system 70 also eliminates the need for an intervening directional valve and provides direct control of the movement of the swing cylinders 54, 56 by using the pump 72 that delivers energy to the system. System complexity is greatly reduced.

Many of the control and performance problems in the open circuit swing control system 20 are linked to the swing control valve 34 and its design. Because the closed circuit swing control system 70 utilizes a closed circuit pump 72, the oil demand on the reservoir 84 is limited to the case drain flow from the pump 72. This is much less than the flow required with the conventional open circuit swing control system 20. The lower oil demand on the reservoir means that less air will be introduced into the system. Air typically causes adverse effects on the control of the system and system performance.

As with any valve, the swing control valve 34 has some inherent internal leakage. Because the swing control valve 34 is not needed in the closed circuit swing control system 70 of the present invention, the leakage, and therefore the drift, is greatly reduced. Overall system responsiveness and hysteresis is improved by moving control of the system from the valve 34 to the pump control servo 76. The swinging of the boom 14 is proportional to the fluid displacement of the pump 72 and the acceleration of the boom 14 is proportional to the acceleration of the swashplate 74 caused by the stroking of the control servo 76.

The circuit of the present invention is less complex and therefore less costly to manufacture. Since there are fewer components which can fail, the closed control system 70 is more reliable than the open circuit system 20. The closed circuit swing control system 70 of this invention is also easier to install because it has fewer hydraulic connections. Fewer hydraulic connections also means that the circuit is less prone to leakage because each of the connections represents a possible point of leakage.

Thus it can be seen that the present invention at least satisfies its stated objectives.

In the drawings and specification there has been set forth a preferred embodiment of the invention, and although specific terms are employed, these are used in a generic and descriptive sense only and not for purposes of limitation. Changes in the form and the proportion of parts as well as in the substitution of the equivalents are contemplated as circumstances may suggest or render expedient without departing from the spirit or scope of the invention.

What is claimed is:

1. A control system for swing cylinders to position a boom on a backhoe or the like, comprising:

a material handling apparatus comprising a frame, an elongated boom pivotally or swingably attached to the frame, and a pair of double acting hydraulic cylinders on the frame and operatively connected to the boom for swinging the boom with respect to the frame;

a closed hydraulic circuit associated with the frame for controlling the cylinders and adapted to simultaneously extend a piston rod in one cylinder and to withdraw a piston rod in the other cylinder, or vice-versa, to swing the boom with respect to the frame;

a closed circuit pump having a swashplate in the hydraulic circuit;

a control on the swashplate of the pump for directing flow of hydraulic fluid in the circuit to the cylinders; and the control on the swashplate of the pump being the sole means of controlling the cylinders.

2. The control system of claim 1 wherein the pair of double acting hydraulic cylinders includes first and second identical cylinders.

3. The control system of claim 1 wherein the pump is a variable displacement pump.

4. The control system of claim 3 wherein the pump is an over-center pump.

5. The control system of claim 1 wherein the control on the pump is a servo control coupled to the swashplate.

6. In combination with a material handling apparatus including a frame with a boom pivotally attached thereto, a boom swing control system comprising:

a pair of opposing double acting hydraulic cylinders on the frame operatively connected to the boom for swinging the boom with respect to the frame;

a closed circuit over-center variable displacement pump arranged in a closed hydraulic circuit with the cylinders, the pump having a movable swashplate, the cylinders being hydraulically connected with each other and to the pump such that fluid from the pump simultaneously extends a piston rod in one cylinder while withdrawing a piston rod in the other cylinder to swing the boom with respect to the frame;

a control means connected to the swashplate of the pump for controlling pump displacement and direction of fluid flow in the closed hydraulic circuit;

the closed hydraulic circuit being free from control valves and motors operatively located between the pump and the hydraulic cylinders; and the control on the swashplate of the pump being the sole means of controlling the cylinders.

7. The combination of claim 6 wherein the control means is a servo control coupled to the swashplate.

* * * * *